United States Patent [19]

Valsecchi

[11] Patent Number: 4,582,782

[45] Date of Patent: Apr. 15, 1986

[54] ANTISTATIC PHOTOGRAPHIC MULTI-LAYER BASE HAVING A HYDROPHILIC AND HYDROPHOETIC LAYER

[75] Inventor: Alberto Valsecchi, Savona, Italy

[73] Assignee: Minnesota Mining and Manufacturing Company, St. Paul, Minn.

[21] Appl. No.: 618,876

[22] Filed: Jun. 8, 1984

[30] Foreign Application Priority Data

Jun. 7, 1983 [IT] Italy ..... 65210 A/83

[51] Int. Cl.[4] ..... G03C 1/94

[52] U.S. Cl. ..... 430/527; 430/529; 430/531; 430/536; 430/537; 428/413; 428/447; 428/532

[58] Field of Search ..... 430/527, 529, 531, 536, 430/537, 629, 631, 271; 428/413, 447, 532

[56] References Cited

U.S. PATENT DOCUMENTS 3,525,621 8/1970 Miller ..... 430/531

3,786,902 1/1974 van Paesschen et al. ..... 430/527

3,856,530 12/1974 van Paesschen et al. ..... 430/529

4,004,327 1/1977 van Paesschen et al. ..... 430/529

*Primary Examiner*—Jack P. Brammer

*Attorney, Agent, or Firm*—Donald M. Sell; James A. Smith; Mark A. Litman

[57] ABSTRACT

A photographic base is protected against the adverse effects resulting from the accumulation of static electrical charges by providing it with a first antistatic hydrophilic layer and a second protective hydrophobic layer coated onto said first layer, said first layer having been formed by coating onto said base a liquid coating composition comprising a hydrophilic non-diffusing sulfonated polymer in the presence of an epoxy-silane compound. The antistatic base is particularly useful for photographic elements comprising at least one photosensitive image-forming layer, on one side thereof, and the first antistatic layer and the second protective layer on the opposite side thereof. The antistatic layer is durable, abrasion-resistant, non-tacky and can withstand the aqueous photographic processings without adverse effects.

18 Claims, No Drawings

ANTISTATIC PHOTOGRAPHIC MULTI-LAYER BASE HAVING A HYDROPHILIC AND HYDROPHOETIC LAYER

TECHNICAL FIELD

The present invention relates to an antistatic base particularly useful in photography, to a method for producing said base and to a photographic element comprising it.

BACKGROUND OF THE ART

In general, photographic elements comprise a base having photographic layers coated on one or both sides thereof. Photographic layers are for example light-sensitive silver halide emulsion layers, intermediate layers, protective layers, antihalation layers, etc.

The base in particular comprises a film of a self-supporting natural or synthetic polymeric compound such as a poly-α-olefin (e.g. polyethylene or polystyrene), a cellulose ester (e.g. cellulose triacetate), polyester (e.g. polyethyleneterephthalate), a polycarbonate or paper.

Most photographic light-sensitive elements have photographic layers coated only on one surface of the support, the other surface being free of photographic layes. A photographic element suitable for color reproduction comprises for example a base having coated on one surface thereof blue-sensitive silver halide emulsion gelatin layers, green-sensitive silver halide emulsion gelatin layers and red-sensitive silver halide emulsion gelatin layers associated with protective, intermediate and antihalation layers. To obtain the photographic image, said silver halide photographic elements are generally exposed and processed in developer, bleaching and fixing baths.

It is known that electrostatic charges tend to accumulate during the production and the use of photographic elements, because of some surface friction resulting from contact with other surfaces. The light-sensitive layers are sensitized by the discharge of accumulated electrostatic charges and this results in the formation of dots or branched line marks (called "static marks") upon development.

To overcome the adverse effects resulting from the accumulation of static electrical charges, it is conventional practice to include an antistatic layer in the photographic elements.

Electroconductive water-soluble polymers, such as sulfonated polymers, have been widely used in photographic elements as backing layers to provide static protection by preventing the static build-up through electrical conductivity. A problem with these antistatic layers is their inability to withstand photographic processing baths and their tendency to cause photographic sheets or films to stick together or to stick to other surfaces. Such problems have been solved by coating onto said antistatic layers a protective layer comprising hydrophobic polymers. Such antistatic double layer constructions still suffer from other disadvantages. Thus, for example, "cratering" phenomena and opacity occur upon photographic development, especially when photographic elements are stored at high temperature and high relative humidity before processing. Sections of the element comprising the backing antistatic double layer construction described above, examined after processing with a microscope, show a disruption of the original double layer construction probably due to the penetration of the processing solutions into the backing layers.

SUMMARY OF THE INVENTION

In accordance with the present invention, there is provided an improved antistatic layer coated on a base which is durable, abrasion-resistant, non-tacky and resistant to the aqueous processing baths employed in photographic processing, said antistatic layer having been formed by coating on one side of said base a first layer formed by a liquid composition comprising a hydrophilic non-diffusing sulfonated polymer in the presence of an epoxy-silane compound, and a second layer formed by a liquid composition comprising a hydrophobic film-forming polymeric substance.

DETAILED DESCRIPTION OF THE INVENTION

Accordingly, the present invention relates to a photographic base comprising a polymeric film support coated with a first antistatic hydrophilic layer and a second protective hydrophobic layer coated onto said first layer, said first layer having been formed by coating onto said support a liquid coating composition comprising a hydrophilic non-diffusing sulfonated polymer in the presence of an epoxy-silane compound.

The present invention, in particular, relates to a photographic base as described above, wherein said polymeric film support is a cellulose derivative, preferably a cellulose triacetate. The present invention, still in particular, relates to a photographic base as described above, wherein said hydrophilic sulfonated polymer is polystyrenesulfonic acid, polyvinyltoluenesulfonic acid, polyindenesulfonic acid, (butylmethacrylate-vinyltoluenesulfonic acid) copolymer, (butylacrylate-styrenesulfonic acid) copolymer, polyvinylsulfonic acid or polyvinylbenzal-2,4-disulfonic acid, and preferably is polystyrenesulfonic acid.

The present invention, still in particular, relates to a photographic base as described above, wherein said protective hydrophobic film-forming layer is formed by coating a liquid composition comprising a cellulose derivative, such as cellulose diacetate, cellulose triacetate, cellulose acetate propionate, cellulose acetate butyrate, methylcellulose or ethylcellulose, and preferably cellulose triacetate.

The present invention, still in particular, relates to a photographic base, as described above, wherein said protective hydrophobic film-forming layer is formed by coating a liquid composition containing a synthetic polymer or copolymer, preferably a polymer or copolymer of a polymerizable monomer, such as styrene, vinyl ethers, vinyl esters, acrylic acid esters, vinyl ketones, vinyl chloride and acrylonitrile.

The present invention, still in particular, relates to a photographic base as described above, wherein said epoxy-silane compound is chosen among the compounds described by the following general formula:

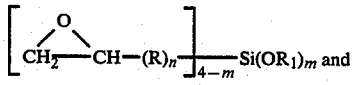

-continued

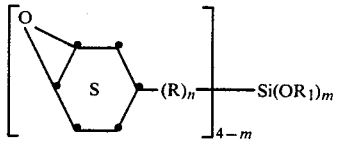

wherein:

R is a divalent hydrocarbon radical of less than 20 carbon atoms (the backbone of which is composed only of carbon atoms or of nitrogen, sulfur, silicon and oxygen atoms in addition to carbon atoms with no adjacent heteratoms within the backbone of said divalent radical except silicon and oxygen);

$R_1$ is hydrogen, an aliphatic hydrocarbon radical of less than 10 carbon atoms or an acyl radical of less than 10 carbon atoms;

n is 0 or 1; and m is 1 to 3, the most preferred epoxy-silane compounds being those of formula:

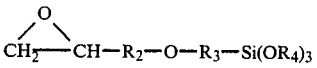

or

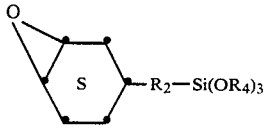

wherein:

$R_2$ and $R_3$ are independently alkylene groups of 1 to 4 carbon atoms; and $R_4$ is hydrogen or an alkyl group of 1 to 10, most preferably 1 to 4 carbon atoms.

The epoxy-silane compounds useful in the present invention are preferably γ-glycydoxypropyl-trimethoxy-silane and β-(3,4-epoxycyclohexyl)-ethyltrimethoxy-silane, the most preferred being γ-glycydoxypropyl-trimethoxy-silane.

The present invention, in another aspect, relates to a photographic element comprising a polymeric film support, at least one photosensitive image-forming layer coated on one side of said support and an antistatic layer on the opposite side of said support, said antistatic layer being formed by a first antistatic hydrophilic layer and a second protective hydrophobic layer coated onto said first layer, said first layer having been formed by coating onto said support a liquid coating composition comprising a hydrophilic non-diffusing sulfonated polymer in the presence of an epoxy-silane compound, as described above.

The present invention, in a further aspect, relates to a method of providing an antistatic layer for a photographic element comprising a polymeric film support coated on one side with at least one photosensitive image-forming layer, said antistatic layer being durable, abrasion-resistant, non-tacky and resistant to attack by aqueous processing baths, said method comprising coating on the opposite side of the support a first liquid composition comprising a non-diffusing hydrophilic sulfonated polymer and an epoxy-silane compound, and drying the coated composition to form a first antistatic layer, then coating onto said first layer a second liquid composition comprising a hydrophobic film-forming polymeric substance, the solvent of said second liquid composition being substantially unable to dissolve the hydrophilic sulfonated polymer of the first antistatic layer.

The sulfonated polymer for use according to the present invention is to be a non-diffusing hydrophilic sulfonated polymer. It has to include a polymeric chain (preferably, a polystyrene chain) having attached thereto sulfonic acid groups in sufficient quantity as to render the polymer sufficiently hydrophilic. It is believed in fact that the efficiency in the polymer antistatic properties is related to the polymer capacity of retaining water and it is to be used within the first antistatic layer of the invention in sufficient amount (as later more specifically described) to render said layer hydrophilic or capable of retaining water to the extent desired for the purposes of the invention. Preferably, for practical applications, at least 20 percent and most preferably 30 percent by weight of the sulfonated polymer is to be constituted by sulfonic acid groups. A natural upper limit to the relative quantity of sulfonic acid groups with respect to the whole acid polymer molecule is given by preparation reasons. A reasonable upper limit appears to be 50 percent by weight.

The sulfonic acid groups are believed to be critical. They could not for example be substituted with carboxylic acid groups.

It has been also found that the sulfonated polymer should be non-diffusing in the practice of the present invention.

A parameter which can be correlated with the aptitute of the sulfonated polymer not to diffuse is the intrinsic viscosity of the polymer itself (measured before having the sulfonic groups attached thereto). The higher the intrinsic viscosity value of the polymer, the lower the tendency to diffuse of the sulfonated polymer derived therefrom. As known, the intrinsic viscosity of a polymer solution is correlated to the molecular weight of the polymer (for a definition of the intrinsic viscosity and for the experimental methods to determine it, see J. Brandrup and E. H. Immergut, Polymer Handbook, Interscience Publishers, 1965, pages IV-1 ff. and F. W. Billmeyer, Textbook of Polymer Chemistry, Interscience Publishers, 1957, pages 128 ff.). When measured at 30° C. in benzene, the minimum value of the viscosity desired within the present invention can reasonably assumed to be equal to about 0.4 dl/g (deciliter/gram), more preferably comprised between 0.8 and 1.40 dl/g.

Sometimes, it can be useful to add the antistatic coating composition comprising the sulfonated polymer with a substantially hydrophobic binder resin, that is a resin having a very low solubility in water, such as less than 1%, for example cellulose esters, cellulose ethers, phenol-formaldehyde resins, vinyl polymers and acrylic polymers. In the case of a cellulose triacetate film support, a good combination is that of dispersing the sulfonated polymer and the cellulose diacetate in said antistatic coating composition. Cellulose diacetate in fact is a "substantially" hydrophobic binder resin, as above defined, and its low solubility in water can be related to the fact that no more than about one third of the cellulose hydroxy groups remains in a non esterified form in the cellulose diacetate resin and the solubility of the cellulose diacetate resin in water is less than 1 percent.

As known in the art, the liquid coating composition of the first antistatic layer of the present invention, comprising the sulfonated polymer, includes a first solvent in which the sulfonated polymer is poorly soluble (e.g. less than 1%) and a second solvent in which the sulfonated polymer is very soluble (e.g. more than 10%). The characteristics of the first layer appear to be dependent to a certain extent on the relative quantity of the second solvent with respect to the first. More precisely, the higher the ratio second/first solvent, as indicated, the higher the antistatic protection of the element. In the case of polystyrenesulfonic acid (mixed or not with cellulose diacetate), a good solvent mixture is known to be the one constituted by acetone and methanol in a relative volume ratio of about 1:1. Ratios higher than 1.5 to 1 of acetone to methanol give very transparent support bases with poor antistatic characteristics, while ratios higher than 1.5 to 1 of methanol to acetone show very good antistatic properties but a loss in transparency. Additional high-boiling organic solvents, such as methylcellosolve acetate, may be used as known to those skilled in the art to improve the heat stability of the coating composition. Additionally, the presence of the first solvent is known to be useful to ensure a good adhesion of the layer to the cellulose triacetate support (what is believed to be due to the attack of the solvent to the support).

The polymeric substance to be coated on the antistatic layer as a protection thereof has to be film-forming and hydrophobic. Illustrative film-forming polymeric substances are cellulose derivatives (such as cellulose diacetate, cellulose triacetate, cellulose acetate propionate, cellulose acetate butyrate, cellulose tripropionate, methylcellulose and ethylcellulose), synthetic addition polymers and copolymers of a polymerizable monomer (such as styrene, vinyl ethers, vinyl esters, acrylic acid esters, vinyl ketones, vinyl chloride and acrylonitrile) and also synthetic condensation polymers (such as polyesters and polyurethanes).

The nature of this polymeric substance will be chosen depending upon the film base nature and possible technical needs. In the case of a cellulose triacetate film base, for example, it may be cellulose diacetate or preferably cellulose triacetate. In the case of a polyester base, it will be a polyester resin (with or without subbings) or a cellulose triacetate resin.

Solvents of the coating composition comprising the polymeric substance above are those organic liquid compounds in which the sulfonated polymer is neither soluble, nor swellable, such as dioxane, chloroform and methylenechloride.

The epoxy-silane compounds of the present invention include an epoxy group and a functional (or reactive) silane group, that is a silanol group whose hydrogen atom is not substituted or is substituted with a group which allows the normal reactions of the silane compounds, reactions which are likely to take place, as known in the art, either through break of the silicon-oxygen bond or through reactions on the hydroxy group (either present in or liberated through hydrolysis of the silane derivative: please note, to this purpose, that silane compounds having an alkyl group directly attached to the silicon atom, wherein no such reaction can take place, do not work in the present invention). Such epoxy and silane groups are linked to each other through a stable and, particularly, non-hydrolizable aliphatic, aromatic, or aliphatic and aromatic divalent bridge (or chain) which may have nitrogen, sulfur, silicon and oxygen atoms in the linkage chain. The oxygen atoms, for example, can be present in the chain only as ether linkages or Si—O linkages. These linkage chains may be generally substituted, as well-known in the art, since these substituents on the chain do not greatly affect the functional ability of said compounds to undergo the essential reactions through the epoxy groups and the functional silane groups. Examples of substituents which may be present on the linkage moieties are groups such as $NO_2$, alkyl, alkoxy, halogen, etc.

Examples of preferred epoxy-silane conpounds useful in the practice of the present invention are compounds of general formula: (please note that the symbol A within a hexagon, as defined by points at vertices thereof, indicates an aromatic nucleus, while an S indicates a saturated nucleus):

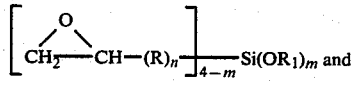

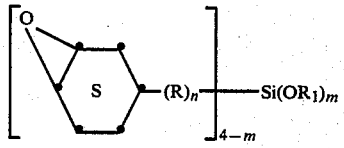

wherein:

R is a non-hydrolizable divalent hydrocarbon radical (aliphatic, aromatic, or aliphatic and aromatic) of less than 20 carbon atoms composed of carbon, hydrogen, nitrogen, sulfur, silicon and oxygen atoms (these are the only atoms which may appear in the backbone of the divalent radicals), the last being in the form of ether linkages or Si—O linkages. No heteratoms may be adjacent within the backbone of the divalent hydrocarbon radical except silicon and oxygen in Si—O linkages;

n is 0 to 1;

$R_1$ is hydrogen, an aliphatic hydrocarbon radical of less than 10 carbon atoms or an acyl radical of less than 10 carbon atoms; and m is 1 to 3.

The compositions used in this invention can employ an epoxy-silane of the above formula in which R is a divalent hydrocarbon radical, such as methylene, ethylene, decalene, phenylene, cyclohexylene, cyclopentylene, methylcyclohexylene, 2-ethylbutylene and allene, and ether radical such as: $—CH_2—CH_2—O—CH_2—CH_2—$; $—(CH_2—CH_2—O)_2—CH_2—CH_2—$;

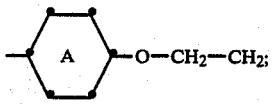

and $—CH_2—O—(CH_2)_3—$, or a siloxane radical such as: $—CH_2(CH_3)_2Si—O—$, $—(CH_2)_2(CH_3)_2Si—O—$, $—CH_2O(CH_2)_3(CH_3)_2Si—O—$; $R_1$ can be an aliphatic hydrocarbon radical of less than 10 carbon atoms such as methyl, ethyl, isopropyl, butyl, vinyl or any acyl radical of less than 10 carbon atoms, such as formyl, acetyl, propionyl.

The most preferred epoxy-silane compounds of the present invention are those of formula:

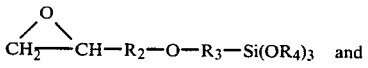

and

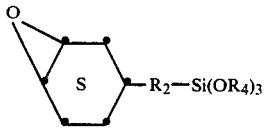

wherein:

$R_2$ and $R_3$ are independently alkylene groups of 1 to 4 carbon atoms;

$R_4$ is hydrogen or an alkyl group of 1 to 10, more preferably 1 to 4 carbon atoms.

Illustrative examples of preferred epoxy-silane compounds useful to the purpose of the present invention are the following:

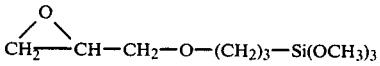

(1)

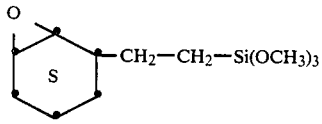

(2)

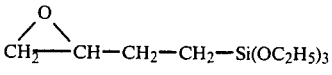

(3)

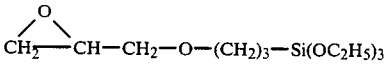

(4)

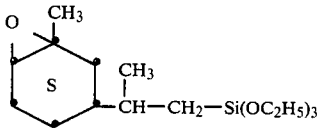

(5)

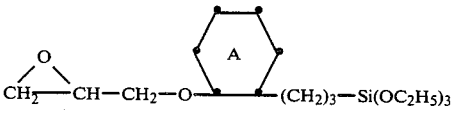

(6)

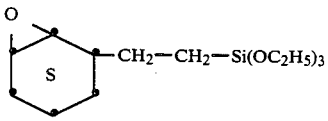

(7)

The epoxy-silane compounds described above can be prepared according to methods known in the art, such as for example the methods described in W. Noll, Chemistry and Technology of Silicones, Academic Press (1968), pp. 171-3 and in Journal of American Chemical Society, vol. 81 (1959), p. 2632.

The antistatic layers formed by coating on the support base a liquid composition comprising the epoxy-silane compounds and hydrophilic sulfonated polymers according to the present invention resulted insoluble in water and in the photographic processing solutions, while in absence of the epoxy-silane compounds they are readily soluble.

There is an uncertainty in explaining the mechanism with which the epoxy-silane compounds make the antistatic layer insoluble. We may reasonably think that the silanol groups (either present or obtained through hydrolisis of the silane derivatives) react via a hydroxy group with the sulfonated polymer, then via the remaining hydroxy groups polymerize to a polysiloxane, or the epoxy group reacts with the sulfonated polymer and the silanol group polymerizes to a polysiloxane, or the epoxy group reacts with the sulfonated polymer and the silane becomes anchored to the surface of the support base by means of its functional groups, or more than one of said mechanisms act to insolubilize the layer.

The presence of both the epoxy group and the silane group are essential to the purposes of the present invention. Compounds containing only epoxy groups, such as polyglycidylmethacrylate, or silane compounds having organic groups other than epoxy groups, such as amino, mercapto, vinyl and acryloyl groups, do not render insoluble the antistatic layer, just like other cross-linking agents, such as glutaraldehyde, glyoxal, dimethylolurea, resorcinolaldehyde and dichlorohydroxytriazine.

The proportions of the ingredients making up the double layer antistatic construction of this invention can be widely varied to meet the requirements of the particular photographic element or base which is to be provided with an antistatic layer. Tipically, the hydrophilic non-diffusing sulfonated polymer of the first antistatic layer will be employed in an amount of about 0.05 to 0.3 grams, and preferably of about 0.1 to 0.15 grams per square meter of the support base, and the weight ratio silane/sulfonated polymer will be in the range of about 0.25 to about 1, and preferably of about 0.4 to 0.6. The hydrophobic film-forming polymeric substance forming the second protective layer is typically employed in an amount of about 0.05 to 0.5 and preferably of about 0.1 to 0.2 grams per square meter of the support. The antistatic double layer construction of this invention can contain other ingredients in addition to the hydrophilic non-diffusing sulfonated polymer, to the epoxy-silane compounds and to the hydrophobic film-forming polymeric substance. For example, as known in the art, there may be incorporated other additives desirable for various purposes, such as surfactants, dyes, plasticizers in the first antistatic layer, and matting agent, surfactants, slipping agents in the second protective layer.

The photosensitive and/or radiation sensitive layers useful for the present invention may be those well-known for imaging and reproduction in the fields such as graphic arts, printing, medical and information systems. Photopolymer, diazo, vesicular image-forming compositions and other systems may be used in addition to silver halide. Photographic silver halide emulsions may be of various content and be negative and/or positive working. The response of the silver halide emulsions may be enhanced and stabilized by such chemical agents as boranes, amines, polyethylene oxides, tetraazaindenes, benzotriazoles, alkali halides, phenylmercaptotetrazoles and gold, mercury and sulfur compounds. In addition, dyes, development modifiers, covering power polymers, surfactants, latices, hardeners and other addenda known in the photographic art may be employed with the photographic silver halide emulsion.

The following experimental work will be able to illustrate better the present invention. The technique used for coating the various layer compositions of the present invention was the so called doctor-roller technique, according to which the film base is not directly dipped into the tray containing the coating composition (in the form of a solution), but receives it from a feeding roller dipping itself into the tray.

Every layer of the support base of the present invention was dried for 2 or 3 minutes at a temperature of about 60°-70° C. before coating thereon a further coating composition at a coating speed of about 350 m/h.

The antistaticity tests were made on the support base of the present invention or on a photographic element including it according to the present invention. The photographic element was including the support base of the present invention having an antistatic layer and a protective layer therefor coated on one side of it plus gelatin silver halide emulsion layers, gelatin interlayers and protective gelatin layers (particularly silver halide emulsion layers associated with couplers, spectral sensitizers, hardeners and any other useful chemical adjuvant known to the man skilled in the art, such as filter dyes, surfactants, antifog agents and stabilizers), coated on the other side of it. Specific tests were made on Color Negative films processed in a normal C41 line for Color Negative. The support base and the Color Negative Films (conditioned for 15 hours at 21° C. and 25% R.H.) were evaluated by measuring the electrical resistivity. Opacity stains and "craters" were evaluated by winding up a sample of 35 mm. base 2 m. long bearing on its back the antistatic layer in contact with the emulsion side of 3M Color Print 100 ASA film and conditioning for 3 days at 60° C. and 70% R.H. After the artificial ageing, the samples were developed in a C41 processing line and their surface was scanned with a lens in order to find opacity stains and craters.

The polystyrene sulfonic acid referred to in the following examples was one having from 35 to 40 percent by weight of sulfonic acid groups and an intrinsic viscosity of 0.85 dl/g. measured in benzene at 40° C. on the non-sulfonated polymer (it was the best of the tested sulfonated polymers including polyvinyltoluene sulfonic acid, polyindene sulfonic acid, (butylmethacrylate-vinyltoluenesulfonic acid)-copolymer, (butylacrylate-styrenesulfonic acid)-copolymer, (ethylhexylacrylate-styrenesulfonic acid)-copolymer, polyvinylsulfonic acid and polyvinylbenzal-2,4-disulfonic acid having intrinsic viscosities measured on the non-sulfonated polymer, ranging from 0.04 to 1.31 dl/g., measured in benzene at 30° C. and having a sulfonic acid group percentage by weight ranging from 15 to 35-40). They have been prepared in a manner known in the art by reacting styrene polymers at temperatures of about −10° C. in 1,2-dichloroethane with a dichloroethylether-sulfur trioxide complex containing 1-1.5 moles of dichloroethylether per mole of sulfur trioxide and then increasing the temperature up to the room temperature under constant agitation (in an analogous was as that described in U.S. Pat. No. 2,533,211).

EXAMPLE 1

Four antistatic coating compositions (A, B, C and D) were prepared according to the following formulations:

| | | A | B | C | D |
|---|---|---|---|---|---|
| Polystyrenesulfonic acid | g. | 5 | 5 | 5 | 5 |
| glycydoxypropyltrimethoxysilane | g. | — | 1.25 | 2.5 | 5 |
| Acetone | ml. | 380 | 380 | 380 | 380 |
| Methanol | ml. | 520 | 520 | 520 | 520 |
| Methyl Cellosolve(R) | ml. | 50 | 50 | 50 | 50 |
| Methyl Cellosolve(R) acetate | ml. | 50 | 50 | 50 | 50 |

Said coating compositions were each coated on the backing side of different portions of a cellulose triacetate suppport base (having coated on the front side a gelatin subbing layer) at a rate of 25 ml/m$^2$. After 2-3 minute drying at 70° C., each antistatic layer was coated with a protective layer having the following composition:

Cellulose triacetate: g. 4.5
Methylenechloride: ml. 900
Methyl Cellosolve ® acetate: ml. 100

After 10-12 minutes drying at 70° C., the electrical resistivity of the backing layer was measured and the opacity and "crater" formation were evaluated as described before.

The following table reports the values of resistivity and the evaluations of opacity and "craters".

| Base | Composition of the antistatic layer | Electrical Resistivity Ω | Opacity stains | "Craters" |
|---|---|---|---|---|
| 1 | A | $3.10^8$ | Present | Many |
| 2 | B | $7.10^8$ | A few | A few |
| 3 | C | $7.10^8$ | Absent | Absent |
| 4 | D | $1.10^9$ | Absent | Absent |

The double layer antistatic layer resulted durable, abrasion-resistant, non-tacky, insoluble in water and in photographic processing baths, free from opacity stains and "craters" in the presence of epoxy-silane compounds.

EXAMPLE 2

Support bases having antistatic backing layers were prepared as described in Example 1 from the following antistatic coating compositions:

| | | E | F | G | H | I | L | M |
|---|---|---|---|---|---|---|---|---|
| Polystyrenesulfonic acid | g. | 5.5 | 5.5 | 5.5 | 5.5 | 5.5 | 5.5 | 5.5 |
| γ-glycydoxypropyltrimethoxysilane | g. | 2.5 | — | — | — | — | — | — |
| γ-(3,4-epoxycyclohexyl)-ethyltrimethoxysilane | g. | — | 2.5 | — | — | — | — | — |
| γ-mercaptopropyltrimethoxysilane | g. | — | — | 2.5 | — | — | — | — |
| γ-methacryloxypropyltrimethoxysilane | g. | — | — | — | 2.5 | — | — | — |
| dimethyldiethoxysilane | g. | — | — | — | — | 2.5 | — | — |
| ethyltriethoxysilane | g. | — | — | — | — | — | 2.5 | — |
| γ-aminopropyltriethoxysilane | g. | — | — | — | — | — | — | 2.5 |
| Acetone | ml. | 380 | 380 | 380 | 380 | 380 | 380 | 380 |
| Methanol | ml. | 520 | 520 | 520 | 520 | 520 | 520 | 520 |
| Methyl Cellosolve(R) | ml. | 50 | 50 | 50 | 50 | 50 | 50 | 50 |
| Methyl cellosolve(R) acetate | ml. | 50 | 50 | 50 | 50 | 50 | 50 | 50 |

The following table reports the evaluation of the presence of "craters" for supports having a first antistatic layer formed by the coating compositions described above and a second protective layer as described in Example 1.

| Base | Composition of the antistatic layers | Opacity stains | "Craters" |
|---|---|---|---|
| 5 | E | Absent | Absent |
| 6 | F | Absent | Absent |
| 7 | G | Present | Many |
| 8 | H | Present | Many |
| 9 | I | Present | Many |
| 10 | L | Present | Many |
| 11 | M | Present | Many |

The support comprising a first antistatic layer and a second protective layer resulted free from "craters" in the presence of epoxy-silane compounds according to the present invention.

I claim:

1. A base for use in a photographic element comprising a polymeric support film with a first antistatic hydrophilic layer thereon and a second protective hydrophobic polymeric layer on said first layer, said first layer comprising a hydrophilic non-diffusing sulfonated polymer and an epoxy-silane compound having both an epoxy group and a reactive silane group which are linked to each other through a stable aliphatic, aromatic, or aliphatic and aromatic divalent bridge.

2. The photographic base as claimed in claim 1, wherein said support film is cellulose triacetate.

3. The photographic base as claimed in claim 1, wherein said hydrophilic sulfonated polymer is polystyrene sulfonic acid.

4. The photographic base as claimed in claim 1, wherein said hydrophilic sulfonated polymer is polyvinyltoluene sulfonic acid, poly(vinylidene) sulfonic acid, (butylmethacrylate-vinyltoluene sulfonic acid) copolymer, (butylacrylate-styrene sulfonic acid) copolymer, (ethylhexylacrylate-styrene sulfonic acid) copolymer, polyvinyl sulfonic acid or polyvinylbenzal-2,4-disulfonic acid.

5. The photographic base of claim 1, wherein said hydrophobic film-forming substance is a cellulose derivative.

6. The photographic base as claimed in claim 1, wherein said cellulose derivative is cellulose diacetate, cellulose triacetate, cellulose acetate propionate, cellulose acetate butyrate, methylcellulose or ethylcellulose.

7. The photographic base as claimed in claim 1, wherein said hydrophobic film-forming polymeric substance is a synthetic polymer or copolymer.

8. The photographic base as claimed in claim 7, wherein said synthetic polymer or copolymer is a polymer or copolymer of a polymerizable monomer selected from styrene, vinyl ethers, vinyl esters, vinyl ketones, vinyl chloride and acrylonitrile.

9. The photographic base as claimed in claim 1, wherein said epoxy-silane compound is represented by one of the formulas:

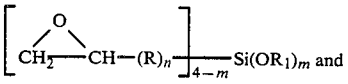

and

-continued

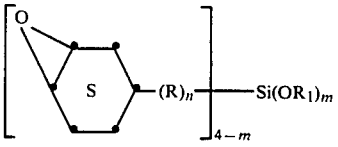

wherein:

R is a divalent hydrocarbon group of less than 20 carbon atoms;

$R_1$ is hydrogen, an aliphatic hydrocarbon group of less than 10 carbon atoms, an acyl group of less than 10 carbon atoms;

n is 0 or 1; and m is 1 to 3.

10. The photographic base as claimed in claim 1, wherein said epoxy-silane compound is represented by one of the formulas:

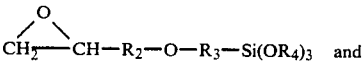

and

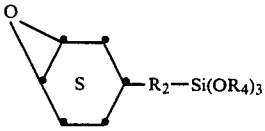

wherein:

$R_2$ and $R_3$ are independently alkylene groups of 1 to 4 carbon atoms; and $R_4$ is hydrogen or alkyl groups of 1 to 10 carbon atoms.

11. The photographic base as claimed in claim 1, wherein said functional epoxy-silane compound is γ-glycydoxypropyltrimethoxysilane.

12. The photographic base as claimed in claim 1, wherein said epoxy-silane compound is β(3,4-epoxycyclohexyl)-ethyltrimethoxysilane.

13. The base of claim 1 wherein said sulfonated polymer is present as from 0.05 to 0.3 grams per square meter on said support, said epoxy-silane is present in a weight ratio to said sulfonated polymer of from 0.25/1 to 1/1, and said hydrophobic polymer layer is present in an amount of from 0.05 to 0.5 grams per square meter of said support.

14. The base of claim 4 wherein said sulfonated polymer is present as from 0.05 to 0.3 grams per square meter on said support, said epoxy-silane is present in a weight ratio to said sulfonated polymer of from 0.25/1 to 1/1, and said hydrophobic polymer layer is present in an amount of from 0.05 to 0.5 grams per square meter of said support.

15. The base of claim 9 wherein said sulfonated polymer is present as from 0.05 to 0.3 grams per square meter on said support, said epoxy-silane is present in a weight ratio to said sulfonated polymer of from 0.25/1 to 1/1, and said hydrophobic polymer layer is present in an amount of from 0.05 to 0.5 grams per square meter of said support.

16. The base of claim 10 wherein said sulfonated polymer is present as from 0.05 to 0.3 grams per square meter on said support, said epoxy-silane is present in a weight ratio to said sulfonated polymer of from 0.25/1 to 1/1, and said hydrophobic polymer layer is present in an amount of from 0.05 to 0.5 grams per square meter of said support.

17. A base for use in a photographic element comprising a polymeric support film in direct contact with a first antistatic hydrophilic layer, and a second layer of a protective hydrophobic polymer layer in direct contact with said first layer, said first layer comprising the product of a sulfonated polymer and an epoxy-silane compound, said epoxy-silane compound having both an epoxy group and a reactive silane group which are linked to each other through a stable aliphatic, aromatic or aliphatic and aromatic divalent bridge.

18. The base of claim 17 wherein said sulfonated polymer is present as from 0.05 to 0.3 grams per square meter on said support, said epoxy-silane is present in a weight ratio to said sulfonated polymer of from 0.25/1 to 1/1, and said hydrophobic polymer layer is present in an amount of from 0.05 to 0.5 grams per square meter of said support.

* * * * *